United States Patent [19]

Bjorklund et al.

[11] 4,123,319

[45] Oct. 31, 1978

[54] PROCESS FOR SIZING CELLULOSE FIBERS

[75] Inventors: James Axel C. Bjorklund, Saltsjo-Boo; Turid Ekengren, Sollentuna, both of Sweden

[73] Assignee: KemaNobel AB, Stockholm, Sweden

[21] Appl. No.: 663,001

[22] Filed: Mar. 1, 1976

[30] Foreign Application Priority Data

Mar. 20, 1975 [SE] Sweden ..... 7503208

[51] Int. Cl.[2] ..... D21D 3/00

[52] U.S. Cl. ..... 162/158; 8/181; 8/194

[58] Field of Search ..... 162/158 R, 158 N; 260/543 PN, 543 P, 959; 427/395; 8/181, 192, 194

[56] References Cited

U.S. PATENT DOCUMENTS

| | | | |
|---|---|---|---|
| 2,130,038 | 9/1938 | Schrader et al. | 260/556 A |
| 2,752,392 | 6/1956 | Saul et al. | 260/543 PN |
| 3,930,932 | 1/1976 | Bjorklund et al. | 162/158 |

FOREIGN PATENT DOCUMENTS 895,960 5/1962 United Kingdom.

OTHER PUBLICATIONS

Matt et al., Chem. Abst., vol. 50, Abst. #8443(b).
Hirai et al., Chem. Abst., vol. 79, Abst. #42152(n).

*Primary Examiner*—S. Leon Bashore
*Assistant Examiner*—Peter Chin
*Attorney, Agent, or Firm*—Fred Philpitt

[57] ABSTRACT

The present invention relates to a process for sizing cellulose fibres or cellulose fibre containing materials and to a composition for carrying out the process. More particularly the invention relates to a process for sizing according to which cellulose fibres in a manner known per se are brought into contact with compounds having the general formula

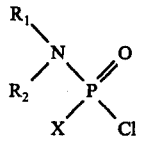

where X is the group

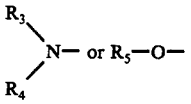

wherein $R_1$ is an organic, hydrophobic group having 8 to 40 carbon atoms and $R_2$, $R_3$, $R_4$ and $R_5$ independent of each other are alkyl groups having 1 to 7 carbon atoms or have the same meaning as $R_1$.

6 Claims, No Drawings

PROCESS FOR SIZING CELLULOSE FIBERS

BACKGROUND

Paper is sized in order to improve the resistance against water and other fluids. The two principal methods for sizing are internal sizing and surface sizing. Internal sizing comprises addition of suitable chemicals to the pulp whereby the chemicals either are absorbed on the cellulose fibres or react with the cellulose. By internal sizing a hydrophobic effect is obtained in the entire paper structure. The effect of surface sizing on the other hand is more or less restricted to the actual surface structure. The two methods are often used in combination.

The agents used for sizing are predominantly rosins, waxes, asphalt emulsions and a number of synthetic chemicals. The former agents are usually fixed to the cellulose fibres by precipitation with alum. The group synthetic sizing agents comprises e.g. alkyl ketene dimers which are chemically bound to the cellulose by reaction with the hydroxyl groups of the cellulose. Other synthetic sizing agents are anhydrides of carboxylic acids, such as stearic acid and alkyl succinic acid, isocyanates, carbamoyl chlorids etc.

THE PRESENT INVENTION

According to the present invention it has been found that good hydrophobic effect is obtained by using the above mentioned compounds as sizing agents. The compounds contain at least one hydrophobic group and a reactive group, P(O)Cl, which can react with the hydroxyl groups of the cellulose.

The compounds which in a manner known per se are brought into contact with cellulose fibres or cellulose fibre containing materials have the general formula

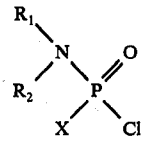

where X is the group

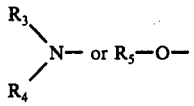

wherein $R_1$ is an organic, hydrophobic group having 8 to 40 carbon atoms and $R_2$, $R_3$, $R_4$ and $R_5$ independent of each other are alkyl groups having 1 to 7 carbon atoms or have the same meaning as $R_1$.

The organic, hydrophobic groups $R_1$ which have been found to be useful for sizing of cellulose fibre material are those in which the hydrophobic group is a hydrocarbon group such as a higher alkyl having at least about 8 carbon atoms, e.g. decyl, undecyl, dodecyl, tridecyl, tetradecyl, pentadecyl, hexadecyl, heptadecyl, octadecyl, tetracosyl and pentacosyl and higher alkyl up to about 40 carbon atoms, if desired, although those having about 12–30 carbon atoms are preferred, the corresponding alkenyl groups having between about 8 and about 40 carbon atoms, among which as examples can be mentioned decenyl, tridecenyl, heptadecenyl, octadecenyl, eicosenyl, tricosenyl etc., aralkyl, alkaryl and alkyl substituted cyclo alkyl having at least about 8 carbon atoms e.g. 4-tert. butylphenyl, octylphenyl, dinonylphenyl, dodecylphenyl, tridecylphenyl, pentadecylphenyl, octadecylphenyl, heneicosylpenyl, nonylcyclopropyl, dodecylcyclobutyl, tridecylcyclopentyl, tetradecylcyclohexyl, pentadecylcycloheptyl, octadecylcyclohexyl etc., and any of these groups containing oxygen or non-interfering inert substituents. Among inert substituents can be mentioned carboalkoxy, alkyloxy, aryloxy, arylalkyloxy, keto, tert. amide groups etc. As examples of radicals which should not be present to any appreciable extent in the hydrophobic group can be mentioned hydroxyl groups, primary and secondary amino groups, amide groups containing amide hydrogen and carboxyl groups or other acid groups. It is obvious to persons skilled in the art, which groups can be used in these compounds if undesired side reactions are to be avoided. $R_1$ is suitably a straight, branched och polycyclic alkyl group having 12–30 carbon atoms and $R_2$, $R_3$, $R_4$ and $R_5$ are independent of each other alkyl groups having 1 to 7 carbon atoms or have the same meaning as $R_1$.

Compounds of this type are previously known.

Cellulose fibres which are sized according to the present invention can be in the form of a water suspension or in condensed form, e.g. as paper, board, cardboard. The cellulose fibres can also be combined with other materials, e.g. plastics.

The hydrophobic effect is independent of the manner according to which the compounds are brought into contact with the cellulose fibres or the cellulose fibre containing material. The process can thus be carried out by stock addition of the compounds to a water suspension of cellulose fibres. Condensed forms of cellulose fibres can be sized by immersion into e.g. a water dispersion or a solution of the compounds. Alternatively the compounds in suitable formulation can be applied by coating.

A suitable manner to produce paper having hydrophobic properties consists of adding the compounds to a water suspension of the fibres before the wire part of a conventional papermaking machine. After dewatering of the fibre suspension on the wire the wet sheet is passed through the press and drier section whereby the hydrophobic effect starts to develop. The hydrophobic effect is completely developed partly on the tambour partly on subsequent storing.

The time for developing full hydrophobic effect of the agents according to the present invention can be considerably reduced by carrying out the sizing in the presence of a chloroformate or an isocyanate, which suitably contain alkyl groups having 12 to 30 carbon atoms. These compounds have an accelerating effect on the reaction while the total hydrophobic effect is substantially unchanged. The ratio of sizing agent to chloroformate and isocyanate respectively is suitably selected within the range of from 1:0.05 to 1:1, preferably 1:0.1 to 1:0.7.

At stock addition the compounds are suitably in the form of a a dispersion whereby cationic, anionic or nonionic emulsifiers are used. To obtain stable dispersion a combination of the above mentioned types of emulsifiers can also be used. Cationic emulsifiers are preferably used, e.g. polyethylene amine, polyamide resin, cationic starch, quaternary ammonium compounds etc. suitably in an amount of 0.1–10 percent by weight based on the sizing agent. The dispersion can also, if desired, contain agents for acceleration of the reaction, particular retention agents etc. Other sizing agents can also be used in combination with those according to the present invention and either form part of the dispersion or be added separately to the pulp.

The invention thus also relates to a composition for carrying out the process. A paper sizing composition according to the invention comprises a water dispersion of the sizing agent together with at least one emulsifier known per se and optionally containing a chloroformate or an isocyanate as accelerator for the reaction between the sizing agent and the cellulose.

At stock addition to cellulose fibres or at surface sizing the compounds according to the invention are used in amounts exceeding 0.001 percent by weight based on dry fibres. The upper limit is not critical but is decided from economical reasons. An addition within the range 0.005–5 percent by weight is suitably chosen, preferably 0.005–0.5 percent by weight based on dry fibres. The cellulose fibre suspension or the condensed cellulose fibre containing material can contain additives usual in paper making, such as fillers, retention agents, flocculation agents etc.

The invention is further described in the following examples, which, however, are not intended to limit the same. Percent and parts relate to percent by weight and parts by weight respectively, unless otherwise stated.

EXAMPLE 1

Unsized paper sheets having a surface weight of 70 g/m² were formed in a laboratory sheet machine from bleached sulphate pulp. The sheets were impregnated by immersion in toluene solutions of the phosphorus compound. The sheets were dried and cured for 1 hour at 105° C. Cobb-number was thereafter determined according to SCAN-P 12:64.

| Sizing agent | % based on dry fibres | $Cobb_{60}$ g/m² |
|---|---|---|
| 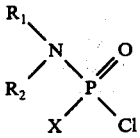 X = 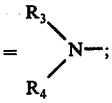 N—; $R_1=R_2=R_3=R_4=C_{18}H_{37}$ | 0.2 | 14 |
| X = 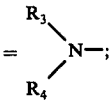 N—; $R_1=R_2=R_3=R_4=C_{18}H_{37}$ | 0.1 | 15 |
| X = 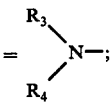 N—; $R_1=R_2=R_3=R_4=C_{12}H_{25}$ | 0.4 | 18 |
| X = 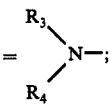 N—; $R_1=R_2=R_3=R_4=C_{18}H_{37}$ | 0.4 | 23 |
| X = $R_5$—O—; $R_1=R_2=C_{18}H_{37}$ <br> $R_5 = C_4H_9$ | 0.4 | 19 |

As comparison can be mentioned that unsized paper absorbs more than 130 g/m².

EXAMPLE 2

In this example the curing time was evaluated for sizing systems containing N,N,N',N'-tetrastearyl phosphamoyl chloride as sizing agent and stearyl isocyanate and cetyl chloroformate respectively as accelerating component.

Strips of unsized paper sheets were submerged into toluene solutions containing varying amounts of phosphamoyl chloride and varying amounts of the respective catalyzing components. The strips were dried at room temperature. Thereafter they were cured in heating chamber at 60° C. and taken out after different periods of time for examination of the curing time. The curing time was determined by ink (flotation) test in such a manner that the test strips were placed on a water bath having a pH of 8 containing a dyestuff. The specimens were considered completely sized when no strike-through was obtained after 10 minutes stay on the water surface. The results are shown in the following tables.

| mg sizing agent per 100 ml toluene | % stearyl isocyanate based on the sizing agent | Curing time (min.) |
|---|---|---|
| 80 | 0 | 60 |
| 80 | 10 | 40 |
| 100 | 0 | 55 |
| 100 | 10 | 30 |

| mg sizing agent per 100 ml toluene | % cetyl chloroformate based on the sizing agent | Curing time (min.) |
|---|---|---|
| 80 | 0 | 60 |
| 80 | 15 | 57 |
| 100 | 0 | 55 |
| 100 | 15 | 48 |

We claim:

1. A process for sizing cellulose fibers or cellulose fiber containing materials wherein cellulose fibers in aqueous suspension or in paper products are reacted with at least 0.001 percent by weight based on dry fibers of a sizing agent, said sizing agent being a compound having the general formula

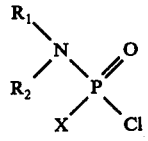

where X is the group

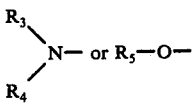

wherein $R_1$ is an organic, hydrophobic group having from 8 to 40 carbon atoms and $R_2$, $R_3$, $R_4$ and $R_5$ independent of each other are alkyl groups having 1 to 7 carbon atoms or have the same meaning as $R_1$.

2. A process according to claim 1, wherein $R_1$ is an alkyl group having from 8 to 40 carbon atoms and $R_2$, $R_3$, $R_4$ and $R_5$ independent of each other are alkyl groups having 1 to 7 carbon atoms or have the same meaning as $R_1$.

3. A process according to claim 1, wherein $R_1$ is an alkyl group having from 12 to 30 carbon atoms and $R_2$, $R_3$, $R_4$ and $R_5$ independent of each other are alkyl groups having 1 to 7 carbon atoms or have the same meaning as $R_1$.

4. A process according to claim 1, wherein X is the group

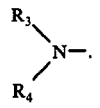

5. A process according to claim 1, wherein X is the group $R_5$-O-.

6. A process according to claim 1, wherein said fibers are reacted with said sizing agent in the presence of a chloroformate or an isocyanate whereby the ratio of sizing agent to chloroformate and isocyanate respectively is within the range of from 1:0.05 to 1:1.

* * * * *